US011891829B2

(12) United States Patent
McEvilly et al.

(10) Patent No.: US 11,891,829 B2
(45) Date of Patent: Feb. 6, 2024

(54) CONVERTIBLE TENT HAMMOCK

(71) Applicant: Kammok Holdings, LLC, Austin, TX (US)

(72) Inventors: Greg McEvilly, Austin, TX (US); Henry Parker, Austin, TX (US)

(73) Assignee: Kammok Holdings, LLC, Austin, TX (US)

( * ) Notice: Subject to any disclaimer, the term of this patent is extended or adjusted under 35 U.S.C. 154(b) by 14 days.

(21) Appl. No.: 17/230,529

(22) Filed: Apr. 14, 2021

(65) Prior Publication Data

US 2021/0317678 A1 Oct. 14, 2021

Related U.S. Application Data

(60) Provisional application No. 63/009,951, filed on Apr. 14, 2020.

(51) Int. Cl.

| | |
|---|---|
| ***E04H 15/04*** | (2006.01) |
| ***A45F 3/22*** | (2006.01) |
| ***E04H 15/60*** | (2006.01) |
| ***E04H 15/36*** | (2006.01) |
| ***E04H 15/30*** | (2006.01) |

(52) U.S. Cl.

CPC ..... *E04H 15/04* (2013.01); *A45F 3/22* (2013.01); *E04H 15/30* (2013.01); *E04H 15/36* (2013.01); *E04H 15/60* (2013.01)

(58) Field of Classification Search

CPC ..... E04H 15/04; E04H 15/30; A45F 3/22

See application file for complete search history.

(56) References Cited

U.S. PATENT DOCUMENTS

| | | | | |
|---|---|---|---|---|
| 961,704 | A * | 6/1910 | Mark | A45F 3/22 5/121 |
| 4,057,859 | A * | 11/1977 | Setterholm | E04H 15/04 5/128 |
| 4,071,917 | A * | 2/1978 | Mojica | E04H 15/04 135/96 |
| 5,913,772 | A * | 6/1999 | Clark | E04H 15/04 5/128 |
| 7,699,068 | B2 * | 4/2010 | Helsdon | A45F 3/22 135/96 |
| 8,936,034 | B2 * | 1/2015 | Rhett, Jr. | E04H 15/34 135/96 |
| 9,347,238 | B2 * | 5/2016 | Dominick | A61G 1/04 |
| 10,000,942 | B2 * | 6/2018 | Hanson | A47C 17/645 |
| 2005/0188460 | A1 * | 9/2005 | O'Brien | E04H 15/04 5/120 |

(Continued)

FOREIGN PATENT DOCUMENTS

| | | | | |
|---|---|---|---|---|
| WO | WO-0204767 | A1 * | 1/2002 | A45F 3/24 |
| WO | WO-2017063009 | A1 * | 4/2017 | |

*Primary Examiner* — Noah Chandler Hawk

(74) *Attorney, Agent, or Firm* — Travis Banta; Loyal IP Law, PLLC

(57) ABSTRACT

Disclosed herein is a convertible tent hammock. The hammock may include side release buckles which allow the floor of the convertible tent hammock to be separated from the corners of the convertible tent hammock. Further, an exposed ridge pole provides a first structural connection to a support structure. The head and foot of the convertible tent hammock may be cinched together to provide a second structural connection to a support structure.

15 Claims, 3 Drawing Sheets

(56) References Cited

U.S. PATENT DOCUMENTS

| | | | | |
|---|---|---|---|---|
| 2012/0005827 | A1* | 1/2012 | Clark | A45F 3/22 5/120 |
| 2014/0216511 | A1* | 8/2014 | Brown | A45F 3/22 135/93 |
| 2021/0000245 | A1* | 1/2021 | Rodet | E04H 15/02 |

* cited by examiner

CONVERTIBLE TENT HAMMOCK

BACKGROUND

1. Technical Field

This disclosure relates generally to a convertible tent hammock. More specifically, a tent which may be set up on the ground may also be hung from supporting structures, such as trees, creating a hammock with attached fly.

2. Description of the Related Art

Hanging tents are a relatively recent adaptation of camping tents. Hanging tents have found popularity because of the novelty of being suspended off the ground to sleep but, more practically, also because hanging tents are typically substantially more comfortable to sleep in than sleeping on the ground. These hanging tents include floors which are, for the most part, connected to a tree to stretch fabric that provides the floor to make the floor taut and capable of supporting the weight of one or more campers. Many of these hanging tents also include a roof, attached to the floor either directly or via walls. These roofs may also be held up by support poles or may also be attached to a tree for support in cooperation with a taut floor or may be solely supported by hanging from a tree or other structural element.

One of the drawbacks of these hanging tents is that the tautness of the floor must be maintained because the structural rigidity of hanging tents, for the most part is dependent on having a tight floor. This tautness can also lead to a somewhat uncomfortable sleeping surface because the tautness of the floor is somewhat unyielding. Further, tents which are solely reliant on hanging from a tree are susceptible to being blown by wind or spinning, which can also cause discomfort to sleeping campers.

A need exists, therefore, to provide a hanging tent which does not rely on the tautness of the floor to provide structural support for the hanging tent. A need also exists for a tent which is not solely supported from above.

SUMMARY

Disclosed herein is a convertible tent hammock. The convertible tent hammock may include a floor. The convertible tent hammock may also include a fly. The floor and the fly are selectively connected to allow the floor to function as a hammock when the floor and the fly are disconnected. The floor is a tent floor when the floor and the fly are connected.

BRIEF DESCRIPTION OF THE DRAWINGS

The accompanying drawings illustrate an embodiment of a convertible hammock tent.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the hammock strap disclosed herein. While the techniques and embodiments will primarily be described in context with the accompanying drawings, those skilled in the art will further appreciate that the techniques and embodiments may also be practiced in other similar apparatuses.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
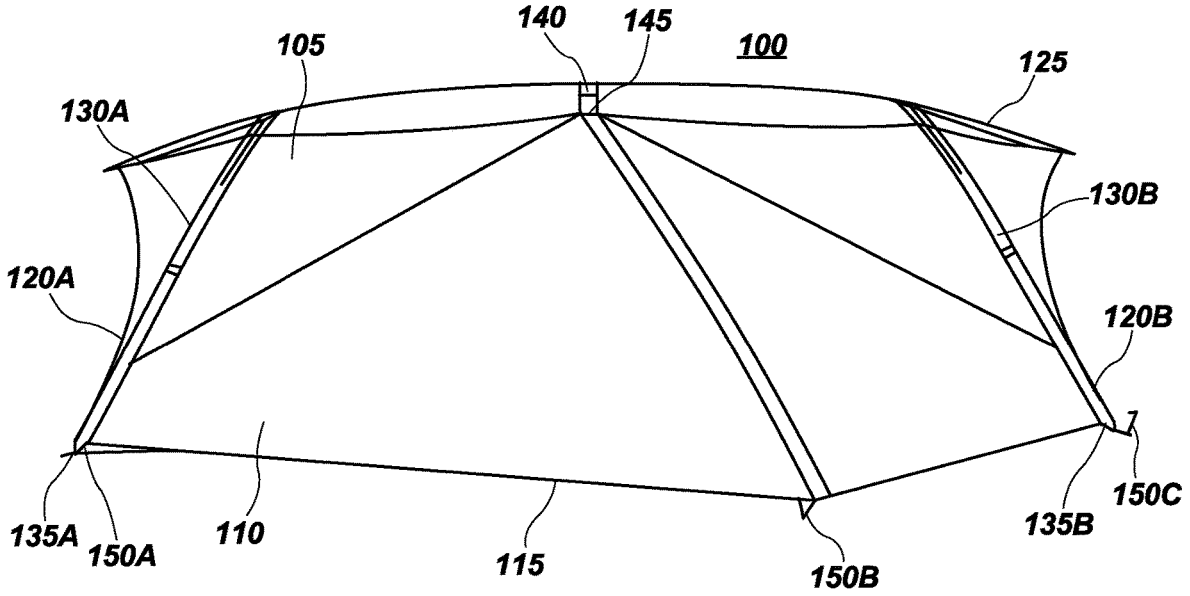
FIG. 1 illustrates an exemplary implementation of a convertible tent hammock in tent mode.

FIG. 1 illustrates an exemplary implementation of a convertible tent hammock 100 in tent mode. As shown in FIG. 1, convertible tent hammock 100 includes a fly 105, walls 110, and floor 115, which may be made using a textile fabric such as acrylic, lycra, nylon, polyester, and other similar fabrics, or combinations of fabrics. Convertible tent hammock 100 may further include a head end 120A and a foot end 120B, which are referenced for orientation only. In other words, head end 120A and foot end 120B could easily be reversed and are structurally identical except for being disposed at opposing ends of convertible tent hammock 100.

Structural support for convertible tent hammock 100 may be provided by a ridge pole 125 which extends laterally (along the length of convertible tent hammock 100 e.g., parallel to floor 115) down the approximate midpoint of convertible tent hammock 100. Ridge pole 125 may extend past an end of convertible tent hammock 100 on both sides of convertible tent hammock 100. Further structural support may be provided by a first arch pole 130A, connected to a connector 135A on opposing sides of convertible tent hammock 100 (the opposing side of first arch pole 130A and a connector similar to 135A on the opposing side of first arch pole 130A are not shown due to perspective). Further structural support for convertible tent hammock 100 may be provided by a second arch pole 130B, connected to a connector 135B on opposing sides of convertible tent hammock (although, as before, a connector matching to connector 1356 and an opposing side of second arch pole 1306 are not shown due to perspective. A third arch pole 140 may be connected at an approximate horizontal midpoint of convertible tent hammock 100 and may connect to a connector 145, which may be the same or a second type of connector different from connector 135. In one example, connector 145 may be a pocket which accepts and secure one end of arch pole 140. (It is noted here, also, that an opposing side of third arch pole 140 may be connected to another connector like 145 positioned on the opposing side of third arch pole 140, which cannot be seen in FIG. 1 due to perspective.

As shown in FIG. 1, convertible tent hammock 100 is positioned in tent mode and may be affixed to the ground with stakes in loops such as such as 150A, 150B, and 150C, although more or fewer stakes may be used as necessary or preferred by the user. In this manner, a user may access a door (not shown) underneath fly 105 and have access to convertible tent hammock 100. Convertible tent hammock 100 may include two opposing doors which allows a user to enter one side and exit through another side of convertible tent hammock 100

Figure 2:
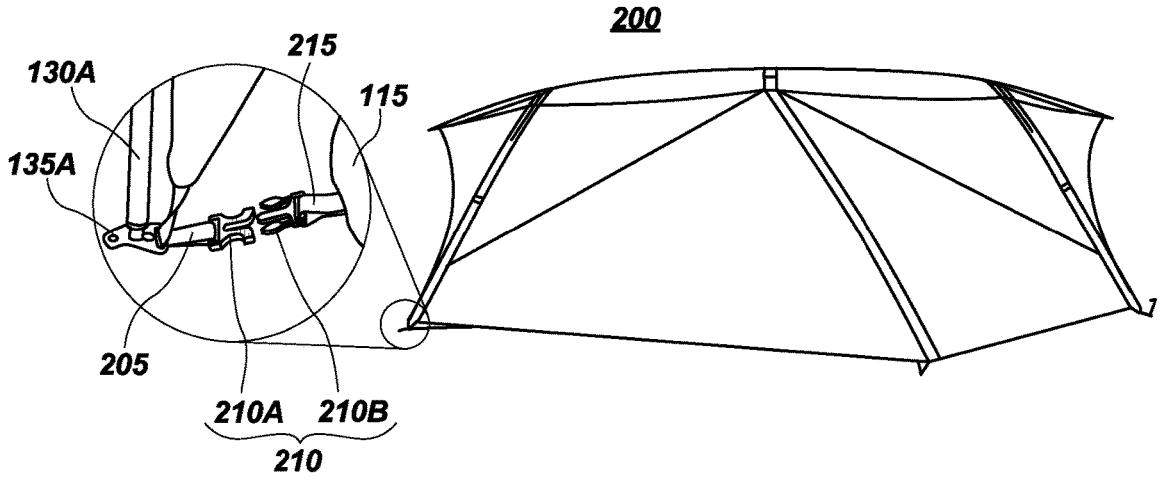
FIG. 2 illustrates a side release connection for the convertible tent hammock.

FIG. 2 illustrates a side release connection for the convertible tent hammock. As shown in FIG. 2, convertible tent hammock 200 is shown in relation to convertible tent hammock 100 and incorporates the element numbers and structure from convertible tent hammock 100, shown and described above with respect to FIG. 1. As shown in FIG. 2, an arch pole, such as first arch pole 130A (or second arch pole 130B although for description, reference will only be made to first arch pole 130) may be connected to a connector 135A, shown in FIG. 1 using, for example, a ball and socket connector. At the same time, fly 105 may be connected through connector 135A by an optional strap 205 to a buckle 210. Buckle 210 may include a first end 210A which mates with and securely connects with a second end 210B, as shown in FIG. 2. However, it is noted that any connector known in the art that may allow floor 115 to disconnect from fly 105 may be used. Buckle 210 may be a connector of any type and is not limited to the specific types of connectors shown here for purposes of discussion. Buckle 210 may also be implemented as two separate elements which attach, independently of each other, to an arch pole, such as first arch pole 130A.

As further shown in FIG. 2, buckle 210B may be connected by an optional strap 215 to floor 115. Buckle 210 may be selectively attached and disconnected according to a user's preference for whether or not the convertible tent hammock should be in tent mode or in hammock mode. Further similar connections may be disposed on each of the four corners of convertible tent hammock 200 shown in Figures and convertible tent hammock 100, shown in FIG. 1. In this manner, floor 115 may be disconnected from the structural elements, such as first arch pole 130A which allows floor 115 to become indirectly reliant on structural elements, such as first arch pole 130A, second arch pole 130B, third arch pole 140, and ridge pole 125. Fly 105, walls 110, and floor 115 may be connected by stitching which causes floor 115 to be still connected and reliant on such structural elements, but also be disconnected and indirectly reliant on such structural elements, as will be discussed below.

Figure 3:
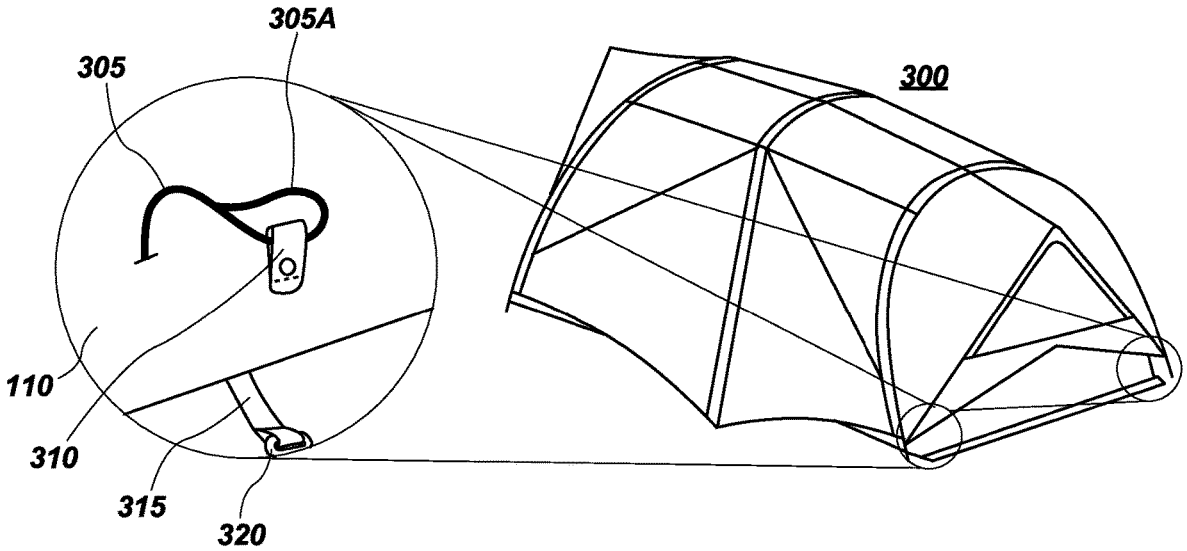
FIG. 3 illustrates a cinch cord of a head and foot of the convertible tent hammock.

FIG. 3 illustrates a cinch cord 305 disposed of a head and foot of the convertible tent hammock 300. As shown in FIG. 3, convertible tent hammock 300 is shown in relation to convertible tent hammock 100 and incorporates the element numbers and structure from convertible tent hammock 100 and 200, shown and described above with respect to FIGS. 1 and 2. As shown in FIG. 3, cinch cord 305 may be connected to wall 110 and may be fitted with a loop 305A which includes a button strap 310. Button strap 310 includes a button, or another connector which may be secured to a second strap 315 and connector 320 when in tent mode. Otherwise, cinch cord 305 may be drawn together with another cinch cord, as will be described below, to draw a head 120A or foot 120B of convertible tent hammock 300 together. It is noted that each corner of convertible tent hammock 300 may be fitted with a similar cinch cord 305, although not explicitly shown in FIG. 3 due to perspective and repetition.

Figure 4:
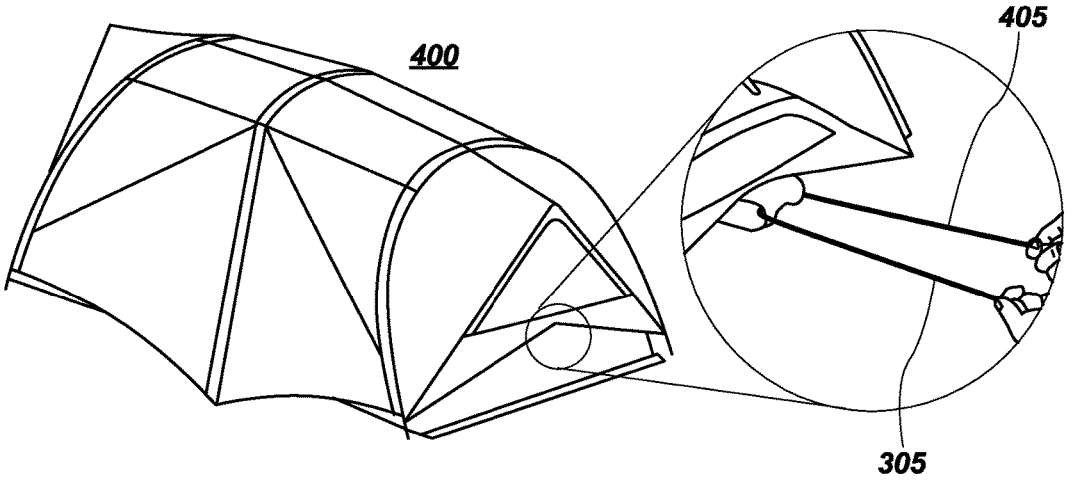
FIG. 4 illustrates cinching the head and foot of the convertible tent hammock.

FIG. 4 illustrates cinching the head 120A and foot 120B of convertible tent hammock 400. As shown in FIG. 4, convertible tent hammock 400 is shown in relation to convertible tent hammock 100 and incorporates the element numbers and structure from convertible tent hammock 100, 200, and 300 shown and described above with respect to FIGS. 1, 2, and 3. As shown in FIG. 4, cinch cord 305, shown in FIG. 3, and cinch cord 405 which are connected to opposing corners of convertible tent hammock 400 (e.g., both head end 120A corners or both foot end 120B corners) may be drawn together in a cinching motion to pull floor 105 together in a gathered end. In other words, the horizontal length of convertible tent hammock 400 may be gathered together by drawing cinch cord 305 and cinch cord 405 together. Gathering cinch cord 305 and cinch cord 405 may facilitate conversion of convertible tent hammock 400 from tent mode into hammock mode, as will be discussed below.

Figure 5:
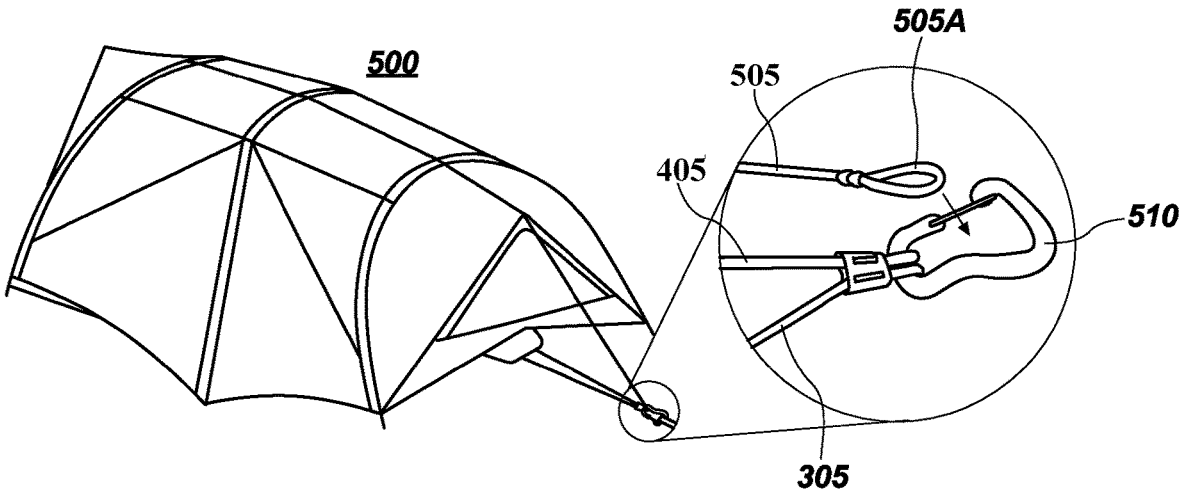
FIG. 5 illustrates structural connections for the convertible tent hammock.

FIG. 5 illustrates structural connections for the convertible tent hammock 500. As shown in FIG. 5, convertible tent hammock 500 is shown in relation to convertible tent hammock 100 and incorporates the element numbers and structure from convertible tent hammock 100, 200, 300, and 400 shown and described above with respect to FIGS. 1, 2, 3, and 4. As shown in FIG. 5, cinch cords 305 and 505 may be connected to a connector 510, which may be a latched or unlatched connector, such as a carabiner, which is shown in FIG. 5. Cinch cord 305 and ridge pole cord 505 may be gathered together by pulling on cinch cord 305 and ridge pole cord 505 to cinch convertible tent hammock 500 together for conversion to hammock mode. Cinch cord 405 may also be permanently attached to connector 510 and be implemented as an elastic cord which is stretched between opposing ends of convertible tent hammock 500 and which adds structural support to a floor 115, as shown in FIG. 1, of convertible tent hammock 500. In this manner, convertible tent hammock 500 may be drawn together both vertically (e.g., between cinch cord 305/505) and horizontally (e.g., between cinch cord 305/405) to convert convertible tent hammock from tent mode into hammock mode.

Ridge pole cord 505, cinch cord 405, and cinch cord 305 may be connected to ridge pole 125 or may alternatively be connected to a ridge pole strap and connector (not shown) on a first end and may include a loops 505A on a second end which may also connect to connector 510. In this manner cinch cord 305, cinch cord 405, and ridge pole cord 505 may be connected at a single point to connector 510 such that each one of cinch cord 305, cinch cord 505, and ridge pole cord 505 are positioned to support at least a portion of a payload (e.g., campers, gear, etc.) disposed within convertible hammock tent 500.

Figure 6:
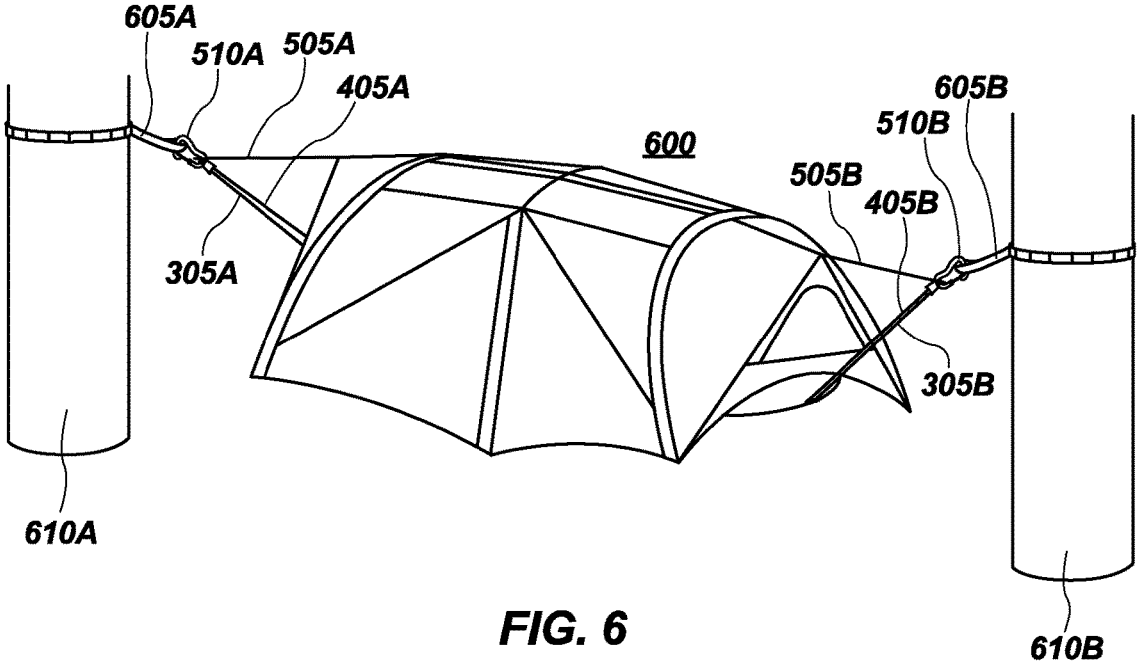
FIG. 6 illustrates the convertible tent hammock in hammock mode.

FIG. 6 illustrates convertible tent hammock 600 in hammock mode. As shown in FIG. 6, convertible tent hammock 600 is shown in relation to convertible tent hammock 100 and incorporates the element numbers and structure from convertible tent hammock 100, 200, 300, 400, and 500 shown and described above with respect to FIGS. 1, 2, 3, 4, and 5. As shown in FIG. 6, convertible tent hammock 600 is connected by hammock straps 605A and 605B to support elements 610A and 610B, which in most cases, may, but need not be, trees. Further, as discussed in FIG. 5, cinch cord 305A, cinch cord 405A, and ridge pole cord 505A are connected to connector 510A which also connects to hammock strap 605A. Similarly, cinch cord 305B, cinch cord 505B, and ridge pole cord 505B are connected to connector 510A which also connects to hammock strap 605B. In this manner, convertible tent hammock 600 is provided in hammock mode where fly 105 and walls 110 cover floor 115 which is configured as a hammock. Floor 115 arranged as a hammock provides more comfort than standard hanging tents because floor 115 in hammock mode is less taut and less rigid than hanging tents. Further, fly 105 and walls 110 provide protection from rain and wind while also allowing a camper to enjoy a hammock type experience and comfort.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A convertible tent hammock, comprising:

a floor;

a fly, wherein the floor and the fly are connectable, the floor being selectively connectable to the fly at each corner of the floor by buckles selectively connectable to each corner of the floor and connected to each corner of the fly;

at least one cinch cord attached to one corner on one end of the floor, a ridge pole, a ridge pole cord connected to the ridge pole, a connector that attaches to the at least one cinch cord and the ridge pole cord, wherein the at least one cinch cord selectively draws a first corner closer to a second corner of the one end of the floor into a cinched position when the buckles connected to each corner of the fly on the one end of the floor are selectively disconnectable from the fly; and wherein an outside edge of the fly extends outward beyond the floor when the cinch cord draws together the first and the second corner of the one end of the floor closer together into a cinched position and the buckles connected to each corner of the fly on the one end of the floor are selectively disconnectable from the fly.

2. The convertible tent hammock of claim 1, wherein the floor is rectangular, and the floor and the fly are connected at four corners of the rectangular floor.

3. The convertible tent hammock of claim 1, wherein the connection between the floor and the fly is a buckle.

4. The convertible tent hammock of claim 1, wherein the ridge pole extends along the length of the fly.

5. The convertible tent hammock of claim 4, further comprising a first arch pole and a second arch pole.

6. The convertible tent hammock of claim 5, wherein the first arch pole and the second arch pole are disposed at opposing ends of the convertible tent hammock.

7. The convertible tent hammock of claim 6, wherein the ridge pole is disposed over the first arch pole at a first end of the ridge pole and over the second arch pole at a second end of the ridgepole along a ridge of the convertible tent hammock.

8. The convertible tent hammock of claim 1, further comprising a first arch pole which connects to the fly by a buckle, among the buckles, having a first end.

9. The convertible tent hammock of claim 8, wherein the buckle, among the buckles, includes a corresponding second end attached to the floor.

10. The convertible tent hammock of claim 8, wherein the first arch pole includes a second buckle, among the buckles, having a first end.

11. The convertible tent hammock of claim 10, wherein the second buckle, among the buckles, includes a corresponding second end attached to the floor.

12. The convertible tent hammock of claim 1, further comprising a first arch pole which connects to the fly by a pocket in the fly.

13. The convertible tent hammock of claim 1, further comprising one or more stake loops.

14. The convertible tent hammock of claim 1, further comprising a first connector which suspends a first end of the convertible tent hammock above the ground.

15. The convertible tent hammock of claim 14, further comprising a second connector disposed on a second end of the convertible tent hammock opposite of the first end which suspends a second end of the convertible tent hammock above the ground.

* * * * *